United States Patent [19]

Elkins et al.

[11] 3,931,893

[45] Jan. 13, 1976

[54] RIFLE MOUNTING RACK FOR SLIDING WINDOW ASSEMBLIES

[76] Inventors: Johnny C. Elkins, 1909½ Pulliam St.; Marvin C. Hanz, 423 S. Irving, both of San Angelo, Tex. 76901

[22] Filed: Feb. 24, 1975

[21] Appl. No.: 552,302

Related U.S. Application Data

[63] Continuation-in-part of Ser. No. 256,509, May 24, 1972, and a continuation-in-part of Ser. No. 401,983, Oct. 1, 1973, Pat. No. 3,876,079.

[52] U.S. Cl. ..... 211/64; 211/87; 224/42.45 R

[51] Int. Cl.[2] ..... A47F 5/08; A47F 7/00

[58] Field of Search ..... 211/87, 64, 86, 94; 224/42.45 A, 42.45 R

[56] References Cited

UNITED STATES PATENTS

| | | | |
|---|---|---|---|
| 2,536,293 | 1/1951 | Koses | 224/42.45 A |
| 2,550,796 | 5/1951 | Francis | 224/42.45 A |
| 2,585,118 | 2/1952 | Hansen | 224/42.45 R |
| 2,599,824 | 6/1952 | Griffin | 211/87 |
| 2,647,669 | 8/1953 | White | 224/42.45 A |
| 2,746,661 | 5/1956 | Kaplan | 224/42.45 A |
| 2,764,332 | 9/1956 | Lemley | 224/42.45 A |
| 3,007,582 | 11/1961 | Lindstrom | 211/87 |
| 3,294,247 | 12/1966 | Norrington | 211/64 |
| 3,876,079 | 4/1975 | Elkins et al. | 211/64 |

*Primary Examiner*—Ramon S. Britts
*Attorney, Agent, or Firm*—Marcus L. Bates

[57] ABSTRACT

A rifle mounting rack for sliding window assemblies of a truck, comprised of a pair of spaced support members which are secured to a vehicle sliding window assembly in laterally spaced relation. Each support member comprises co-acting slide members having rifle receiving cradle members depending therefrom, and diametrically opposed window frame engaging members which can be slidably received within a flange of the rear window assembly of a vehicle.

13 Claims, 12 Drawing Figures

RIFLE MOUNTING RACK FOR SLIDING WINDOW ASSEMBLIES

CROSS REFERENCE TO RELATED APPLICATIONS

The instant application is a Continuation-in-part of parent application Ser. No. 256,509, filed May 24, 1972, and patent application Ser. No. 401,983, filed Oct. 1, 1973, now U.S. Pat. No. 3,876,079.

BACKGROUND OF THE INVENTION

Vehicle window mounting racks for rifles and the like are known in the prior art and take on various different forms such as exemplified by the U.S. Pat. Nos. to Lindstrom 3,007,582; Norrington 3,294,247; Francis 2,550,796; Kaplin 2,746,661; and Koses 2,536,293.

As evidenced by these prior art examples, vehicle window racks for supporting objects therefrom are sometimes complex in design and potentially detrimental to the structure of the vehicle especially where the window frame member must be jacked apart in order to provide anchoring means for the rack. Alternatively, structural members of the vehicle must be drilled and fitted with a fastener means which not only requires limited skilled use of hand or power tools, but also defaces the interior of the vehicle. Moreover, direct attachment of the rack to any structural component of the vehicle inherently transmits undesirable loads from the vehicle into the rack and consequently into a rifle cradled by the rack. Often, when the vehicle is traveling on rough roads, the rifle is actually dislodged from its cradle. Moreover, imparting sudden heavy loads into the rifle could inadvertently cause the rifle to be discharged.

Accordingly, it is desirable to provide improvements in a mounting rack for rifles which can be readily and easily installed in spaced superimposed relationship upon a rear sliding window assembly of a vehicle without defacing the vehicle interior; which can be readily and securely installed without the use of tools and the like; which is adjustable from one size window to another; and, which can be removed from the vehicle whenever it is desired to do so. It is further desirable that such a mounting rack be situated in a manner whereby a minimum of vehicle loads are transmitted into the rifle cradled by the rack.

SUMMARY OF THE INVENTION

This invention specifically relates to a vehicle mounting rack for rifles comprised of laterally spaced support members secured in superimposed spaced relationship to a vehicle window. Each support member is comprised of first and second co-acting slide members movable relative to one another, with each member having diametrically opposed support members which are inserted within a u-shaped frame member which also supports the sliding glass of a vehicle window assembly. Outwardly disposed from one support member is a cradle means for supporting a rifle therewithin.

Guide means formed on the co-acting slide members enable the support members to be moved relative to one another in aligned relationship therewith. The support members are aligned in a common plane, with the cradle means being normally opposed thereto, so that a rifle placed within the cradle means is releasably held in spaced relation respective to the vehicle and the window glass.

Accordingly, a primary object of the present invention is the provision of improvements in mounting racks for rifles which can be used in combination with a rear sliding window assembly of a vehicle.

Another object of the invention is to provide a mounting rack for rifles which is readily adjustable so that it can be rapidly assembled and securely supported by components of various different sizes of vehicle sliding window assemblies.

A further object of this invention is to disclose and provide a rifle supporting assembly which can be readily secured for support within a commercially available sliding rear window assembly of a truck.

A still further objet of this invention is to provide a molded plastic mounting rack for rifles which is made of only two co-acting members and is secured in supporting relationship to a sliding window assembly.

These and various other objects and advantages of the invention will become readily apparent to those skilled in the art upon reading the following detailed description and claims and by referring to the accompanying drawings.

The above objects are attained in accordance with the present invention by the provision of apparatus fabricated in a manner substantially as described in the above abstract and summary.

DETAILED DESCRIPTION OF THE PREFERRED EMBODIMENTS

Figure 1:
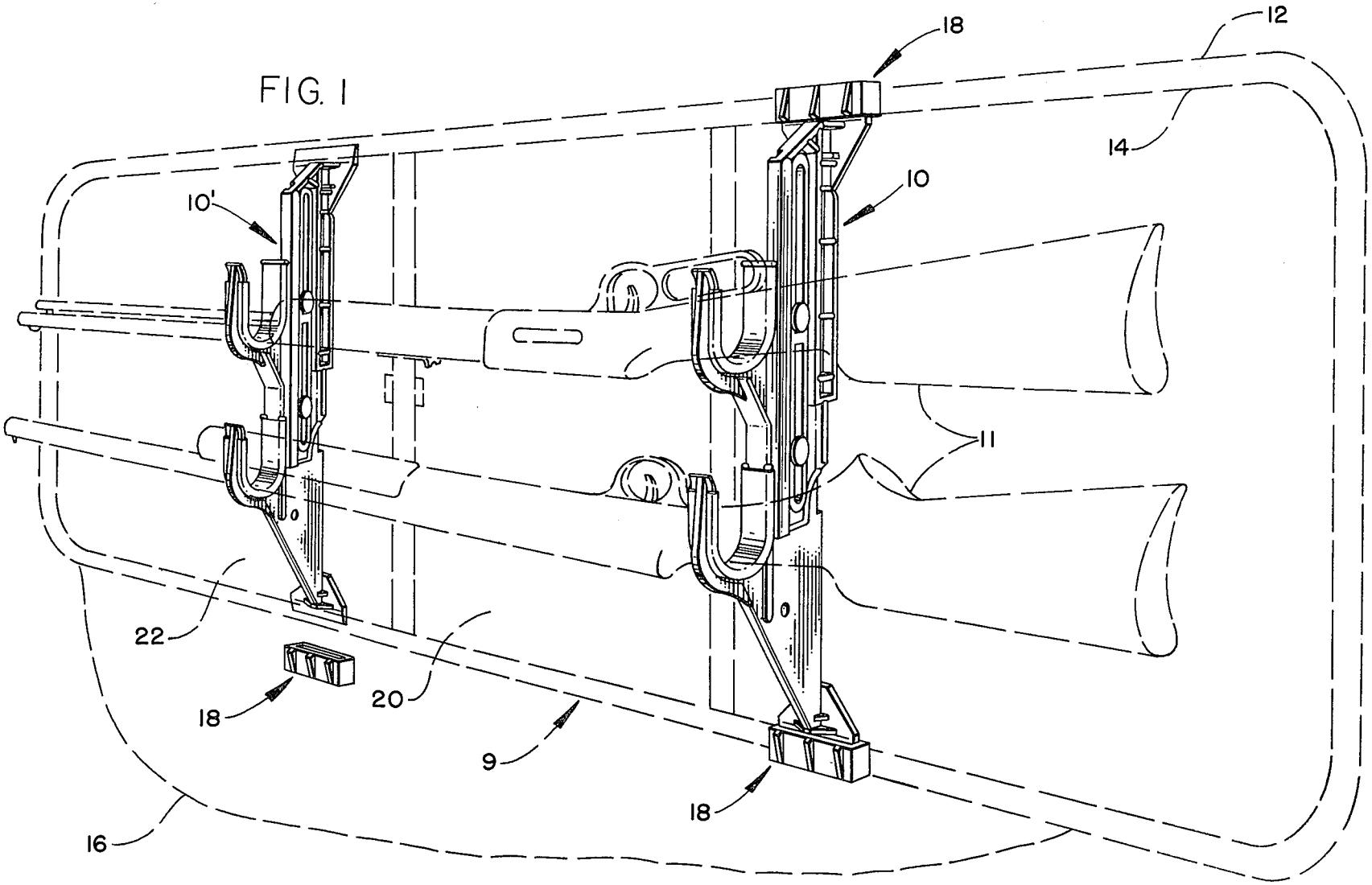
FIG. 1 is an isolated perspective view of an automotive rear sliding window assembly having a mounting rack for rifles, made in accordance with the present invention, operatively associated therewith.

FIG. 1 illustrates a rear sliding window assembly 9 of a vehicle, such as a pickup truck, for example. The window assembly includes the usual frame 12 provided with a suitable gasket or weather stripping 14 which resiliently secures the frame to the vehicle in the usual manner.

A mounting rack for rifles, comprised of a pair of support members 10, 10′, and made in accordance with the present invention, is operatively connected to the frame of the rear window assembly, as will be better appreciated as the remainder of this disclosure is more fully digested.

Figure 4:
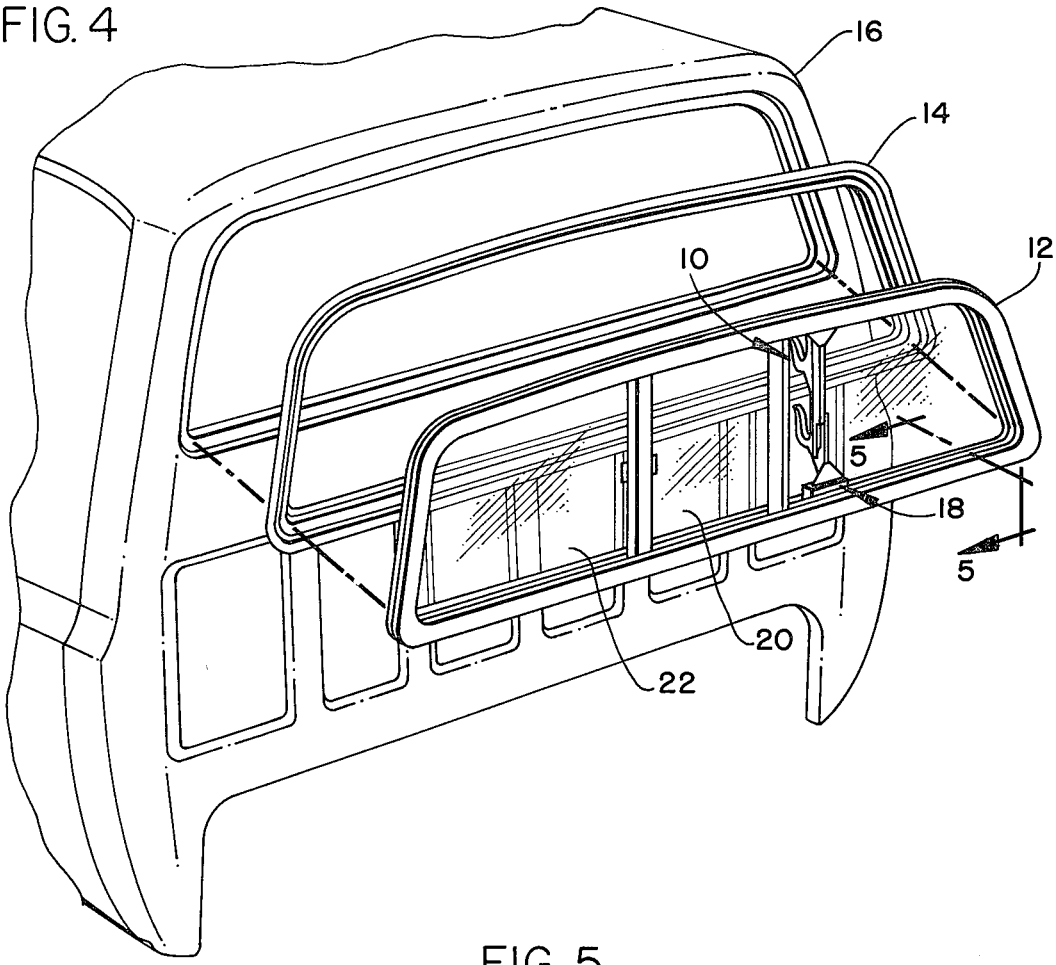
FIG. 4 is a perspective view of part of the apparatus disclosed in FIGS. 1–3.
Figure 5:
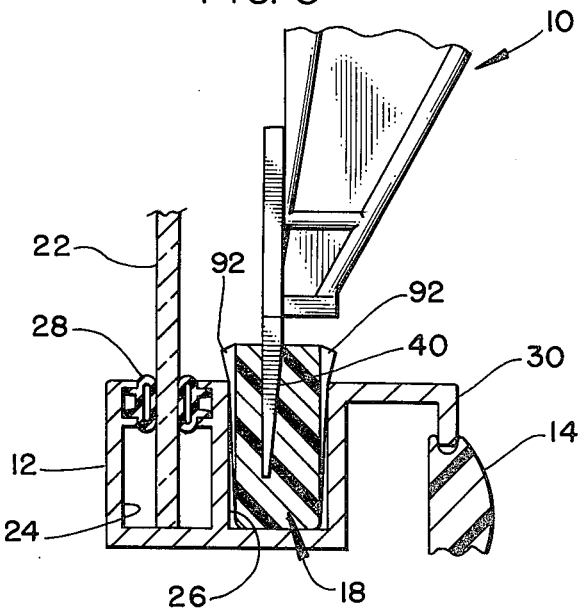
FIG. 5 is an enlarged, fragmentary, cross-sectional view taken along line 5–5 of FIG. 4.
Figure 7:
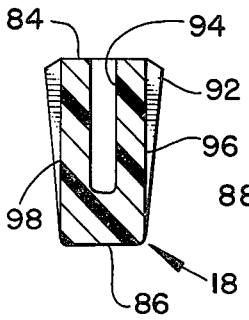
FIG. 7 is a cross-sectional view taken along line 7—7 of FIG. 6.
Figure 6:
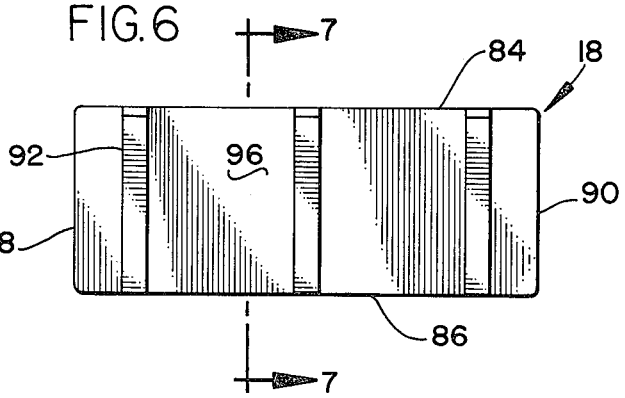
FIG. 6 is a side view of an insert which is associated with one of the support members disclosed in FIGS. 1 and 4.
Figure 8:
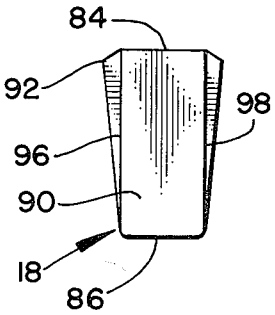
FIG. 8 is an end view of the insert member disclosed in FIG. 6.
Figure 9:
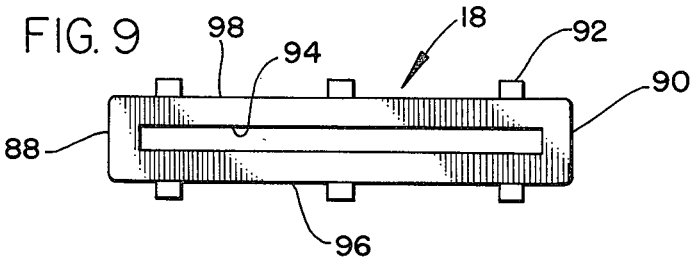
FIg. 9 is a top view of FIG. 6.
Figure 10:
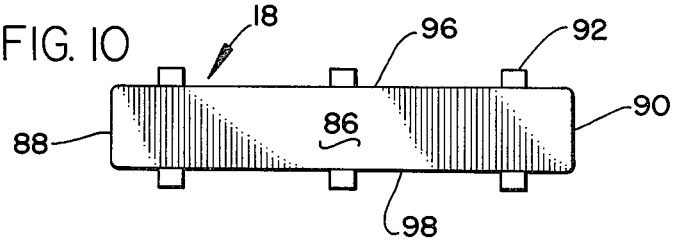
FIG. 10 is a bottom view of FIG. 6.

In FIG. 4, the truck cab is generally indicated by the numeral 16. Spaced pairs of insert members 18 hold ech of the racks in spaced relationship from the sliding window glasses 20 and 22. As best illustrated in FIG. 5, each of the glasses are slidably received in captured relationship within window glass receiving 24 and 26. A small gasket 28 slidably and sealingly engaged opposed parallel surfaces of each individual glass, while the molded metal frame downwardly depends at lip 30 into engagement with the before mentioned weather stripping gasket 14.

Figure 2:
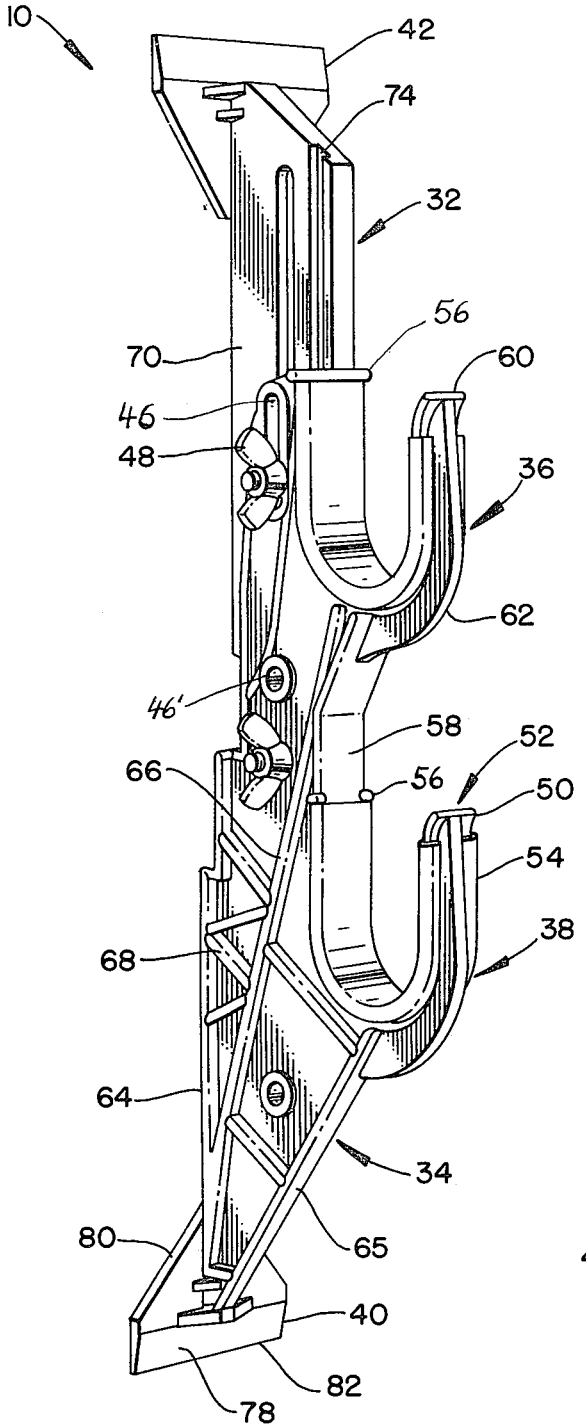
FIG. 2 is an enlarged, perspective view of one of the assembled spaced support members disclosed in FIG. 1.
Figure 3:
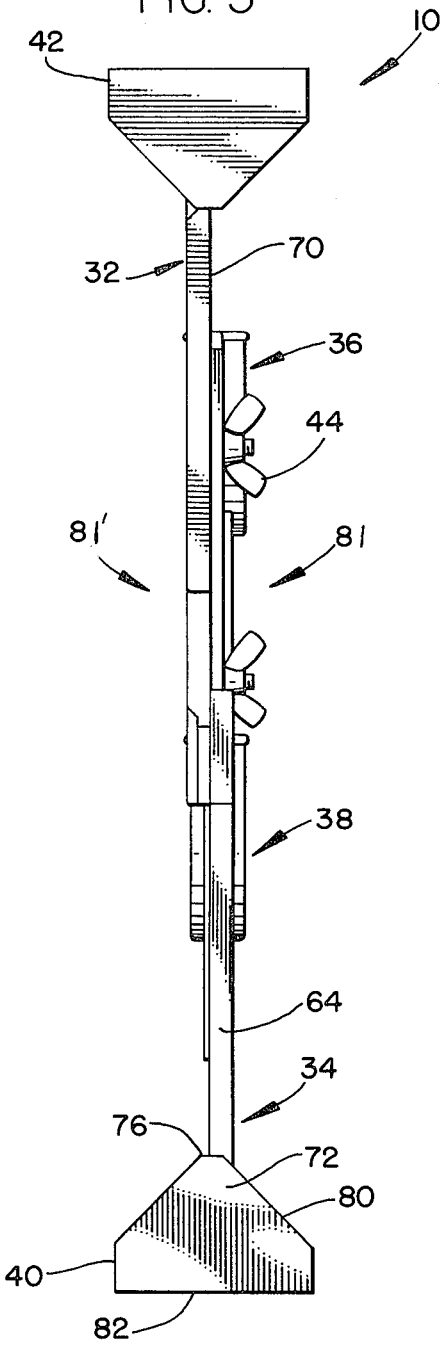
FIG. 3 is a rear view of the assembled support member disclosed in FIG. 2.

As illustrated in FIG. 2, in conjunction with some of the remaining figures, each support member, 10 or 10' of the gun rack, is comprised of a first, or top slide member 32 which is slidably connected to a second or bottom coacting slide member 34. The second, or bottom, slide member has an upper and a lower cradle means, 36 and 38, respectively, integrally connected thereto and outwardly depending therefrom.

A lower blade member 40 is made an integral part of the second or bottom slide member, while an upper blade member 42 is made an integral part of the first or top slide member. The blades of each slide member are diametrically opposed to one another and movable toward and away from one another in accordance with the relative position of the first and second slide members. Friction locks 44 increase the friction between the two slide members to prevent relative movement therebetween. Aperture 46 is provided for enabling the relative travel between the two slide members to be endowed with greater adjustability by placement of fastener 48 therewithin.

Reinforcement web 50 defines the interior surface of the upwardly and outwardly opening cradle and reinforces the free end portion 52 thereof. The web provides an interiorly disposed horizontally aligned flange having opposed shoulders about which there is received a split oval shaped resilient pad 54 so that a rifle placed therewithin cannot be scratched or marred. Additionally, the rifle will be of a size which will compress the pad causing it to resiliently capture the rifle in biased relationship by the cradle means. Diametrically outwardly projecting tits 56 and curved end 52 capture the pad therebetween, so that the pad is not inadvertently dislodged therefrom. The before mentioned web 50 together with the illustrated ribs greatly reinforce the second or bottom slide member and provides a truss-like configuration which strengthens the entire structure. In particular, outer web member 58 commences adjacent to the reinforcement web 60 in attached relationship to the vertical flange 62 of the upper cradle member, and extends in a downward direction where it ultimately forms the inside peripheral surface area of the lower cradle member. The rear reinforcement rib member 64 extends in an upward direction from attachment to the lower blade and describes the rearward and upper peripheral surface of the slide member. The upper portion of rib 64 is joined to web 68 and to the illustrated central body member. Each of the webs 58 and 60 terminate as an integral portion of the vertical flanges which form the cradle members. Diagonal rib member 66 is spaced between the rear and front rib members, 64 and 65 respectively, and connected by the illustrated cross-bracings 68. The cross-bracings together with the elongated rib members provide a monocoque-like structure which adequately bears vehicle induced transverse, tortional, and lateral loads which may be placed thereon by the weight of a rifle or gun placed within the cradle. The low friction face 70 of the first or top slide member is intersected by a longitudinally aligned groove 74 which receives an outwardly extending vertical tongue member located on the second slide member, with the latter being more or less parallel to the glass and to the face 72 of the support blade. As best seen in FIG. 2, the groove 74 extends more or less parallel to the face of the blade of the first slide member. The groove is placed in indexed relationship with the tongue, with the groove being of a sufficient depth to receive the entire outwardly extending tongue therein. The groove is open ended at each extremity of the slide member so that the tongue member can slide in close tolerance relationship therewithin, with a marginal end portion thereof extending from either of the outwardly opening portions of the groove as may be required.

The face of one slide member slidably engages the face of the other slide member in low friction relationship therewith. The illustrated elongated slots are idexed relative to the tongue, groove, apretures, and slot 46 so that as each slide member moves relative to the other, at least two of the apertures 46' are always in alignment wiht the elongated slots, thereby permitting the opposed blades to be adjusted to an infinite number of different spaced positions within the limits of operation of the support member. This expedient enables adjustment of the support member so that it can be fitted into any number of various sized window assemblies.

Each of the blades terminate at 76 as an integral portion of a slide member. Sloped edge 80 of the blade is joined to tapered vertical portion 78 which terminates in a reduced edge portion at 82 to form a horizontal, sharp leading edge portion. Hence, the blade is in the form of a rectangle having an edge portion reduced in thickness, and another portion of the form of a truncated triangle, with the last portion being joined to the main body portion of the slide member as indicated by numeral 76.

FIGS. 6–10 disclose the details of the insert member 18, which is similar in some respects to a wedge. The insert is comprised of a top surface 84, a bottom surface 86, end portions 88 and 90, and spaced vertical ribs 92 located on each of the opposed sides. An upwardly opening longitudinally directed, horizontally disposed cavity 94 extends parallel to the opposed sides 96 and 98 which extend between the ends. The cavity is made into a configuration complementary respective to blades 40 and 42 for receiving a marginal end portion of the blade in close tolerance relationship therewithin.

Figure 11:
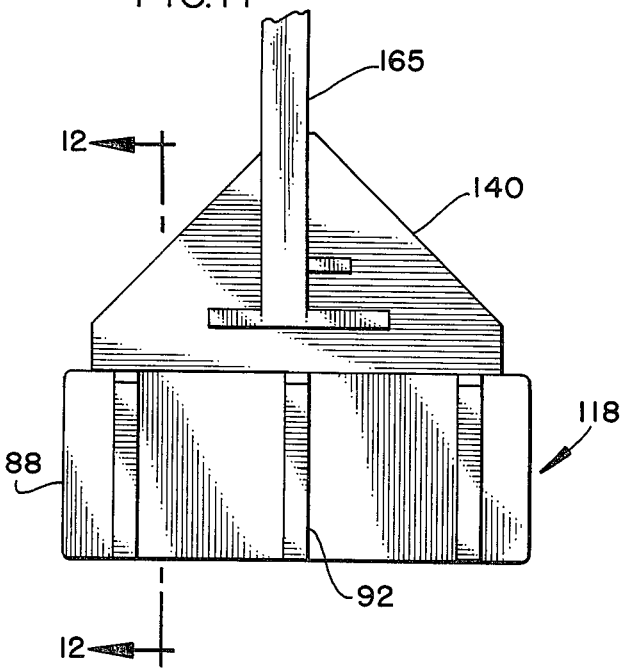
FIG. 11 is an enlarged view of a modification of part of the apparatus disclosed in some of the foregoing figures; and, FIG. 12 is a broken, cross-sectional view taken along lines 12—12 of FIG. 11.
Figure 12:
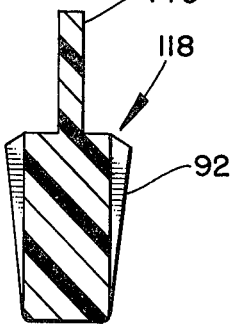

In the embodiment of FIGS. 11 and 12, the wedge-like insert is made integrally with the slide members, with the blade-like member 140 being integrally formed with member 118. The geometrical configuration of member 118 is identical to member 18 except that the slide member is molded integrally with respect to the insert.

In operation, four insert members are inserted within the U-shaped frame of the sliding window assembly. Next, the slide members of FIGS. 1–10 are placed with the smooth sides thereof abutting one another and with the tongue thereof slidably engaging the groove. Fastener means are next placed through the proper apertures as may be required for proper adjustment, and slightly tightened. The marginal ends of the blade members are next fitted into the insert members and the separate slide members are slid vertically apart an amount wich will enable the sharp ends of the blades to be forceably and securely received within the previously set inserts, as illustrated in FIGS. 1 and 5.

The fastener means are then adjusted so that the faces of the slide members are brought together in high friction relationship. This simple expedient completes the installation of the spaced pair of support members, thereby enabling a rifle to be placed within the cradles in the illustrated manner of FIG. 1.

The embodiment of FIGS. 11 and 12 is installed within the longitudinal channel of the metal frame member in the above described manner, except that the wedges are already formed onto the slide members, and hence the entire structure is simultaneously fitted into the frame.

The present invention finds utility when used in conjunction with the sliding rear window assembly found in the pickup truck campers.

I claim:

1. In combination with a vehicle sliding window assembly having at least two window panes with at least one said pane being slidable respective to the other, wherein the glass is slidably captured within spaced opposed channels formed within a window frame of the assembly, a mounting rack for rifles comprising a pair of support members having means by which they are removably and slidably secured solely to the window frame in laterally space relationship to one another;

each support member comprising a first and second slide member; each slide member having a slidable surface formed thereon and an insert means which is inserted in captured relationship within one of the opposed channels of the window frame assembly;

cradle means outwardly disposed from and attached to one of said slide members for contributing to the support of a rifle;

guide means formed on said first and second slide members so that one said slide member can be guidably moved in aligned relationship respective to the other of said slide members;

each said insert means being arranged on each said slide member so that when one slide member is moved relative to the other, the insert means are moved towards and away from one another; said insert means being arranged in a common plane, with said cradle means being normally disposed relative to the plane;

and a fastener means connected to each of said slide member for increasing the friction of said slidable surfaces to effectively lock the slide members together;

said insert means being placed within the channel which receives the window glass by sliding the first member relative to the second member, after which the members may be locked together by the fastener means to support a gun placed in the cradle solely by the insert means.

2. The apparatus of claim 1 wherein said guide means on said first and second slide members includes a longitudinally extending tongue and groove with the groove being formed on one of said slide members and the tongue being formed on the remaining of said slide members, said tongue being slidably received within said groove with the face of one member slidably engaging the face of the remaining member.

3. The apparatus of claim 1 wherein said fastener means includes spaced apertures placed in said first slide member, said second slide member being provided with spaced slots arranged to be placed in registry with said spaced apertures when said tongue is received within said groove, and a bolt means placed through the apertures and slots when the apertures are aligned with the slots.

4. The apparatus of claim 1 wherein each said insert means is in the form of a rectangle which is of a thickness for insertion within the window glass frame, and another portion in the form of a truncated triangle, with the last portion being joined to the main body portion of said slide member.

5. The apparatus of claim 1 wherein said first slide member is an elongated body normally to said insert means, said insert means forms one marginal end portion of said slide member, said insert means and said cradle being an integral part of one said slide member, and means forming spaced ribs along one side of one said slide member.

6. The apparatus of claim 1 wherein each said slide member has a face formed thereon; said guide means on said first and second slide members includes a longitudinally extending tongue and groove with the groove being formed on one of said slide members and the tongue being formed on the remaining of said slide members, said tongue being slidably received within said groove with a face of one member slidably engaging a face of the remaining member;

said insert means being in the form of a rectangle having the opposed sides formed into ribs to present an edge portion reduced in thickness for insertion within the same channel of the frame which slidably supports the window glass.

7. The apparatus of claim 1 wherein each said slide member has a face formed thereon, said guide means on said first and second slide members includes a longitudinally extending tongue and groove with the groove being formed on one of said slide members and the tongue being formed on the remaining of said slide members, said tongue being slidably received within said groove with the face of one member slidably engaging the face of the remaining member;

said first slide member has a blade formed thereon and arranged normally thereto; said blade forming one end portion of said slide member, one said blade and one said cradle being an integral part of one said slide member, one said slide member being an elongated body having means forming spaced ribs along one side thereof for reinforcing the slide member; said insert means having a blade receiving cavity formed therein and being separable from said blade.

8. The apparatus of claim 1 wherein said insert means has a cavity formed therein, and further including a support blade attached to said slide member, said blade having an edge portion reduced in thickness for insertion within said insert means; said blade being joined to the main body portion of said slide member.

9. The apparatus of claim 8 wherein said first slide member is in the form of an elongated body arranged normally to said blade, said blade forming one end portion of said slide member, or one said blade and one said cradle being an integral part of one said slide member, and means forming spaced ribs along one said elongated body for reinforcing one said slide member.

10. In combination with a window frame having at least two window panes, with at least one said pane being slidable respective to the other, said frame having spaced opposed channels which slidably capture marginal edge portions of a pane therein, a mounting rack assembly for supporting a rifle, said rack includes support members, each of said support members being made of a first and second slide member, a slidable surface formed on each said slide member, fastener means securing each said slide member together in adjustable relationship, each slide member having a depending end portion made into the form of a support blade;

an insert means disposed in each of the opposed channels, a blade receiving cavity formed in each said insert means, said insert means and said blade having a configuration whereby a marginal edge portion of said blade is removably received within said cavity;

the gun mounting rack being supported by the window frame with said blades inserted within said cavities of said insert means, with said slide members moved apart, and with said insert means placed in said channels.

11. The apparatus of claim 10 wherein said guide means on said first and second slide members includes a longitudinally extending tongue and groove with the groove being formed on one of said slide members and the tongue being formed on the remaining of said slide members, said tongue being slidably received within said groove with the face of one member slidably engaging the face of the remaining member.

12. The apparatus of claim 10 wherein said insert means is in the form of a rectangle having ribs formed on opposed sides thereof so that the insert means is reduced in thickness for insertion within the channel of the window glass frame, and another portion in the form of a truncated triangle, with the last portion being joined to the main body portion of said slide member.

13. The apparatus of claim 10 wherein each said slide member has a face formed thereon, said guide means on said first and second slide members includes a longitudinally extending tongue and groove with the groove being formed on one of said slide members and the tongue being formed on the remaining of said slide members, said tongue being slidably received within said groove with the face of one member slidably engaging the face of the remaining member;

said first slide member has a blade formed thereon which is arranged normally thereto; one said blade and one said cradle being an integral part of one said slide member, one said slide member being an elongated body and having means forming spaced ribs along said elongated body for reinforcing the slide member; said insert means having a blade receiving cavity formed therein and being separable from said blade.

* * * * *

UNITED STATES PATENT OFFICE

CERTIFICATE OF CORRECTION

PATENT NO. : 3,931,893

DATED : January 13, 1976

INVENTOR(S) : Johnny C. Elkins and Marvin C. Hanz

It is certified that error appears in the above-identified patent and that said Letters Patent are hereby corrected as shown below:

Column 5, Claim 1, line 32, correct the spelling of "spaced".

Column 6, Claim 5, line 18, insert --arranged-- after "body".

Column 6, Claim 9, line 67, delete "or".

Column 7, Claim 10, line 6, insert --opposed-- after "capture".

Column 7, Claim 10, line 8, insert --spaced-- after "includes".

Signed and Sealed this twentieth Day of April 1976

[SEAL]

*Attest:*

RUTH C. MASON
*Attesting Officer*

C. MARSHALL DANN
*Commissioner of Patents and Trademarks*